US005785412A

United States Patent [19]

Wu et al.

[11] Patent Number: 5,785,412

[45] Date of Patent: Jul. 28, 1998

[54] LAMP SOCKET UNIT

[76] Inventors: Jeng-shyong Wu, Fl. 4, No. 5, Hsing Shyue Rd., Hsin-Chu City, Taiwan; Jeou-Nan Tzeng, No. 52-1, Alley 100, Lane 311, Nan Yea Street, Hsin-Chu City, Taiwan

[21] Appl. No.: 548,058

[22] Filed: Oct. 25, 1995

[30] Foreign Application Priority Data

Mar. 20, 1995 [CH] Switzerland ..... 95 2 05137.0

[51] Int. Cl.[6] ..... H01R 33/00

[52] U.S. Cl. ..... 362/226; 362/389; 362/806

[58] Field of Search ..... 362/226, 249, 362/389, 457, 806, 250; 313/318.01, 318.09

[56] References Cited

U.S. PATENT DOCUMENTS

| | | | |
|---|---|---|---|
| 4,935,852 | 6/1990 | Hsu | 362/226 |
| 4,999,751 | 3/1991 | Chen | 362/226 |
| 5,498,922 | 3/1996 | Chang | 362/389 |

*Primary Examiner*—Y My Quach

*Attorney, Agent, or Firm*—McGlew and Tuttle

[57] ABSTRACT

The structure of a lamp socket unit has a lamp bulb, a lamp base and a lamp holder; said lamp bulb comprising vacuum part within in it providing a filament, a rear end and a pair of conductor wires; said lamp base comprising a lug, a neck and an end, said end having two holes, said lug having an opening end, the conductor wires passed through said opening end to enter holes, and said wires to be bent along the outside of said end so that the end of said lamp bulb received within the opening end of said lamp base; said lamp holder being hollow in it, both are opening end, the terminal to be contacted by the conductor wire passing through the rear opening of the lamp holder; the front opening received the end and neck of the lamp base, to cause the conductor wires to be contacted to the terminals so as to complete the electrical circuit; wherein the lug and neck of lamp base having one or more than one elasticity or expandable part, the outside diameter of neck of the lamp base is larger than the inside diameter of the front opening of the lamp holder, when the lamp base with the bulb inserted into the lamp holder, the part of the elasticity of the lamp base is compressed and transfigured, so as to cause the bulb and lamp base fixed in the lamp holder.

11 Claims, 7 Drawing Sheets

PRIOR. ART

LAMP SOCKET UNIT

The present invention generally relates to a lamp socket unit in a Christmas lighting string and more particularly to the combination structure of a lamp socket unit having a lamp bulb, a lamp base and a lamp holder, whereby to increase the fixed combination of the lamp bulb, the lamp base and the lamp holder.

In a conventional lamp socket unit, it generally consists of a lamp bulb, a lamp base and a lamp holder, wherein the lamp bulb is combination together with the lamp base, then the said lamp base together with the bulb is inserted into the lamp holder. To keep the lamp base within the lamp holder firmly, the contacted face between lamp base and lamp holder creates fiction. However, in practice, due to the lamp bulb and the lamp base produced by the reformed plastic material, it is not easily to control the precision in sizes of the lamp base and the lamp holder. Thus the occurred frictional force is not so stable. It is often to cause the defect due to the lamp base and lamp holder too loose or too tight. In case, it is too loose, then both of them are easily to stripe off and the resistance of the contacted face of the electrical circuit will be high so as to have the potential danger to cause the fire. On the contrary, if it is too tight and it will influence the arranged speed of the assembly and thereafter the damage bulb is not easy to be replaced.

The applicant noted that the match is obtained by utilizing the structure of the traditional lamp base and lamp holder by means of the controlling the difference of size to complete their match fixedly. It is hard to reach in practice, due to the difference of material in each production. Further, in order to decrease the producing cost, it is often to use reproduction material of the plastic material. The material, is unstable, and it becomes useless to obtain the frictional force by controlling the difference of the size.

Thus, the object of the present invention is to provide the novel structure of lamp holder and lamp base using in a Christmas lighting string, whereby to obtain the stable combination between said lamp holder and said lamp base.

According to the present invention, it is to provide that the lamp base is integrated, its neck part is arranged a thinner part or shrinkable part or expandable part. Said shrinkable part or expandable part becomes vertical and symmetrical back and forth (or left and right side). The outer diameter of the neck of the lamp base is larger than the inner diameter of the opening part of lamp holder. Therefore, when the lamp base having the lamp bulb, is in combination together with the lamp holder, and the lamp base inserted into the lamp holder the shrinkable or expandable part will be transfigured by compression so that the lamp base is clipped in the lamp holder firmly. Due to the match between the lamp base and the lamp holder, it is easily and conveniently to compress the lamp base and the lamp holder together fixedly. By means of the transfigure of the shrinkable or expandable part, and after assembling, it will not be influenced by the natural force or the other factors. The clipped relationship of them can be maintained. On the contrary, if the separation of the lamp base and the lamp holder is desired, it is only necessary to apply force to the lug of the lamp base so as to pull the base, then the separation of the base from the holder can be obtained. It is then convenient to replace the lamp bulb by pulling out the lamp base from the lamp holder.

Thus, utilizing the structure of the present invention is able to reach the stable combination of the lamp base and the lamp holder. Further, it is easy to make force on the lamp base to reach the purpose of the separation of the lamp base and lamp holder. Such is the main object of the present invention.

Other objects and features will become apparent when the description of preferred embodiments is taken in conjunction with the annexed drawings, of which:

DETAILED DESCRIPTION OF THE PREFERRED EMBODIMENTS

Figure 1:
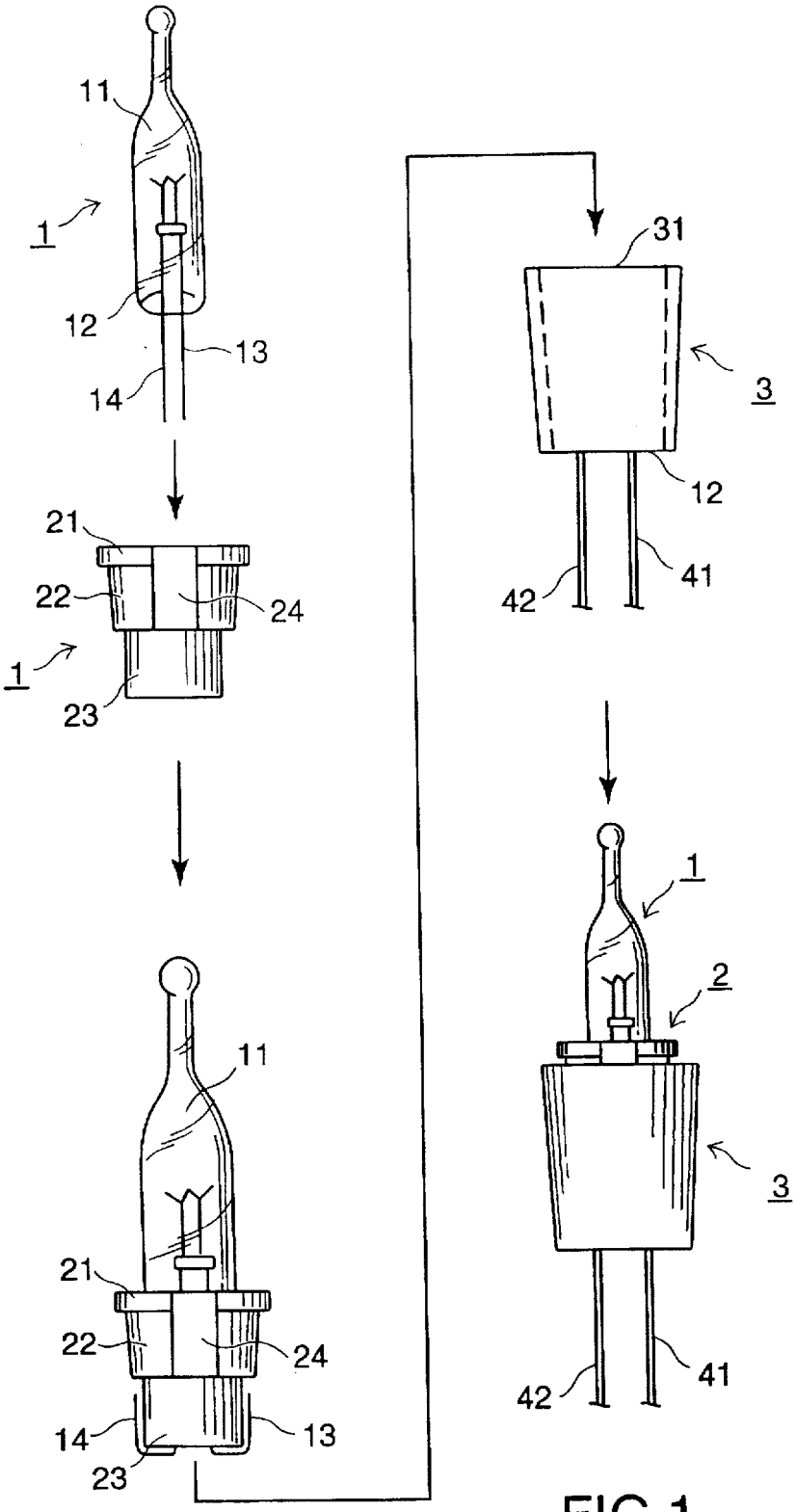
FIG. 1 is an exploded view of the first embodiment of the lamp socket unit of the present invention showing the structure of the combination of the lamp bulb, lamp base and lamp holder.
Figure 2:
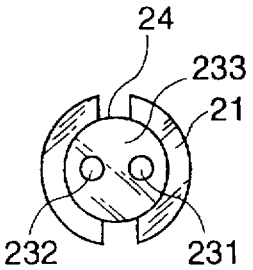
FIG. 2 depicts the top view of the lamp base shown in FIG. 1.

Referring to FIGS. 1 and 2, these drawings show an exploded view and top view of the lamp base with the shrinkable or expandable part. FIG. 1 depicts the combination of the structure of the three main components of the novel lamp socket unit of the present invention, comprising a lamp bulb 1, a lamp base 2 and a lamp holder 3.

The lamp bulb 1 comprises a vacuum part 11 with a filament inside, a rear end 12 and a pair of conductor wires 13, 14; said lamp base 2 comprising a lug 21, a neck 22 and an end 23, said end of the lamp base having two holes 231, 232, said lug having an opening end 233, the conductor wires 13,14 passed through said opening end 233 to enter holes 231, 232, and said wires to be bent along the outside of said end 23 so that the rear end 12 of said lamp bulb 1 received within the opening end 233 of said lamp base 2;

said lamp holder 3 being hollow with two openings at ends 31, 32, the terminals (not shown) to be contacted by the conductor wires 41, 42 passing through the rear opening of the lamp holder; the front end opening 31 received the base end 23 and neck 22 of the lamp base 2, to cause the conductor wires 13, 14 to be contacted to the terminals so as to complete the electrical circuit;

wherein the lug 21 and neck 22 of lamp base having one, or more than one, shrinkable or expandable part 24, the outside diameter of neck 22 of the lamp base 2 is larger than the inside diameter of the front end opening 31 of the lamp holder 3, when the lamp base 2 with the bulb 1 inserted into the lamp holder 3, the part of the elasticity of the lamp base is compressed and transfigured, so as to cause the bulb 1 and lamp base 2 fixed in the lamp holder 3.

The lamp bulb 1 in the novel Christmas lighting socket unit is a bare glass bulb having a front end and a rear end 12. A pair of conductor wires 13, 14 lead out from the filament within the bulb sticking out of the rear end 12.

The bulb 1 is intended to be pushed into a lamp base 2 which has a stepwise body with a front end or bulb opening 233 to take the bulb 1 and a rear end with two holes 231, 232 to anchor the conductor wires 13, 14 led out from said holes.

The lamp holder 3 has a front end opening 31 to take the incoming rear end of the lamp base 2. Prearranged in the rear end opening 32 of the holder 3 is a pair of terminals (not shown) which are to be contacted by the conductor wires 13, 14 passing through the lamp base 2 and being bent over the base end opening 23 when the said base 2 is pushed in through the front end opening 31 of the lamp holder 3. Lug(s) 21 is also optionally provided at the front end opening 31 of the holder 3.

FIG. 2 depicts the top view of the lamp base 2, wherein an elastic deformation means such as a shrinkable or expandable part 24 can be formed in part or whole as a thin lamina. The as a thin lamina part, being shrinkable or expandable is extends through lug 21 and neck 22. Further, the rear end opening 23 of the lamp base 2 is equipped with the conductor wires 13, 14 to pass through the holes 231, 232.

According to the present invention, the lamp bulb 1 is inserted into the front end opening 233 of the lamp base 2 and received within the plastic lamp base 2, a pair conductor wires 13, 14 of the bulb passing through the holes 231, 232 of the rear end of lamp base 2 and being bent up along the rear end opening 23. The lamp holder 3 is also made from the plastic material, in the rear end opening 32 of the holder 3, a pair of terminals (not shown) are to be contacted by the wires 41, 42 passing through the lamp holder 3, and said terminals are close to the inner wall of said lamp holder. When the said base 2 is pushed in through the front end opening 31 of the lamp holder 3, the conductor wires 13, 14 within said lamp holder 3 are compressed to contact to the terminals so as to form the electrical circuit. Concerning the combination of the lamp bulb, the lamp base and the lamp holder, such is the conventional method.

Figure 3:
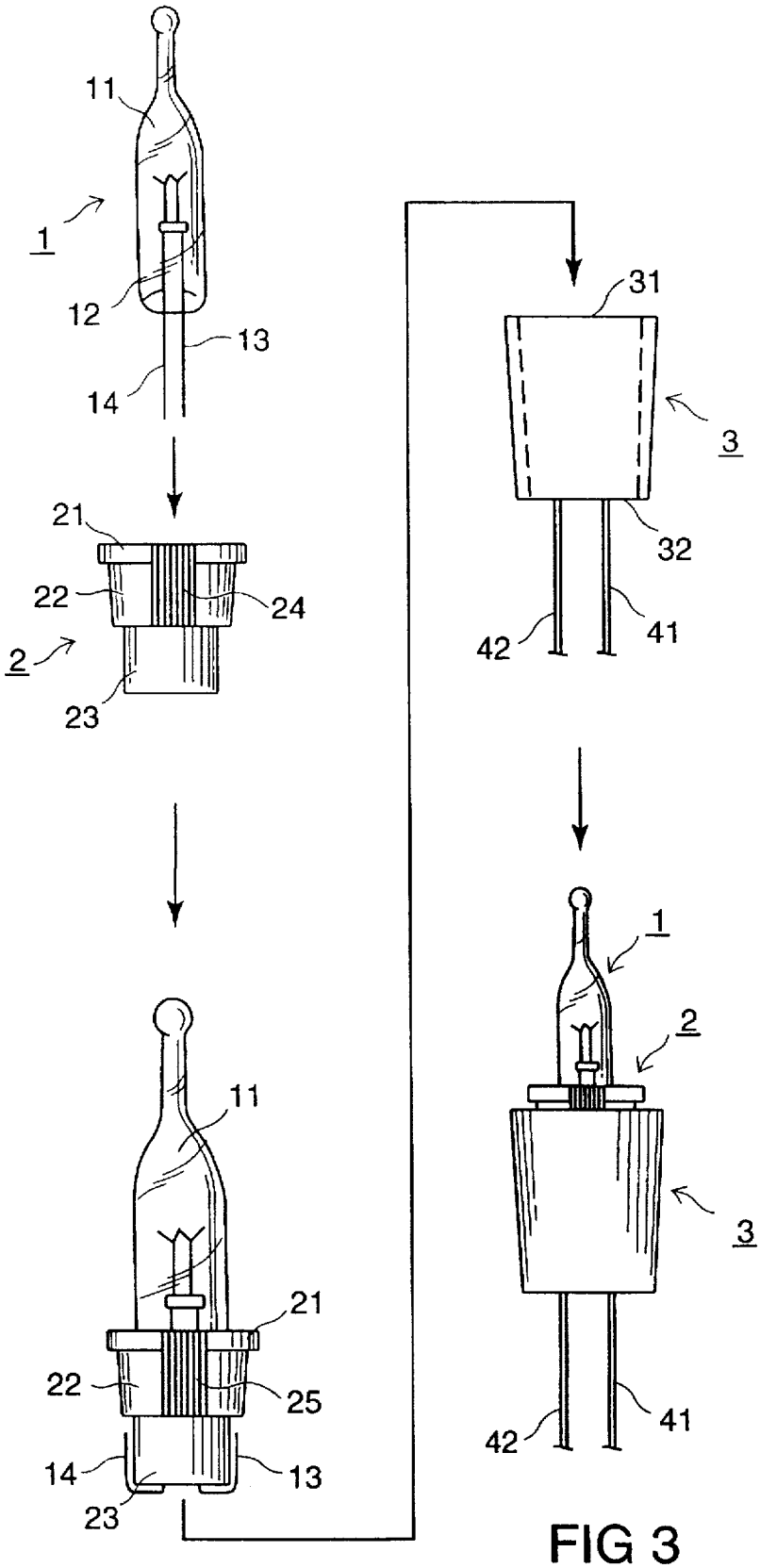
FIG. 3 is an exploded view of the second embodiment of the lamp socket unit of the present invention showing the structure of the combination of the lamp bulb, lamp base and lamp holder.
Figure 4:
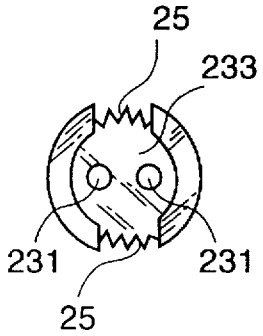
FIG. 4 depicts the top view of the lamp base shown in FIG. 3.

FIG. 3 and 4 are the second embodiment of the lamp socket unit of the present invention showing the structure of the combination of the lamp bulb, the lamp base and the lamp holder. The combination method is completely resembling the FIG. 1. However, the shrinkable or expandable part 25 in the neck 22 of the lamp base 2 is in the form of bending and twisting structure (as shown in FIG. 4).

Figure 5:
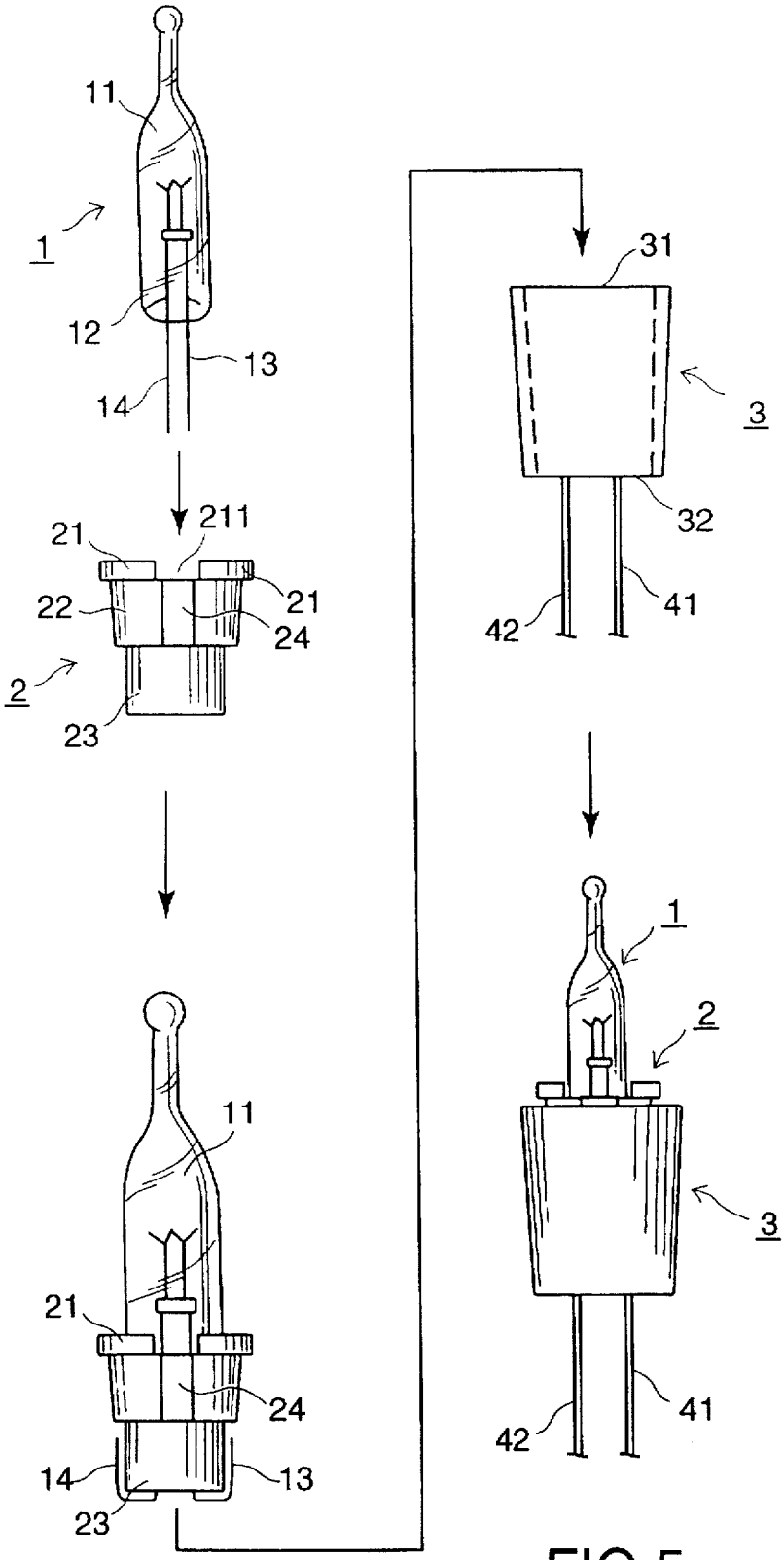
FIG. 5 is an exploded view of the third embodiment of the lamp socket unit of the present invention showing the structure of the combination of the lamp bulb, lamp base and lamp holder.
Figure 6:
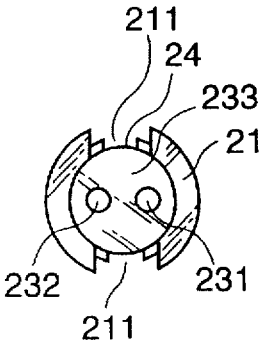
FIG. 6 depicts the top view of the lamp base shown in FIG. 5.

FIGS. 5 and 6 are the third embodiment of the lamp socket unit of the present invention showing the structure of the combination of the lamp bulb, the lamp base and the lamp holder. The combination method is completely resembling the FIG. 1. However, the shrinkable or expandable part 24 in the neck 22 of the lamp base 2 is in the form of two corresponding ladder structures (as shown in FIG. 6).

Figure 7:
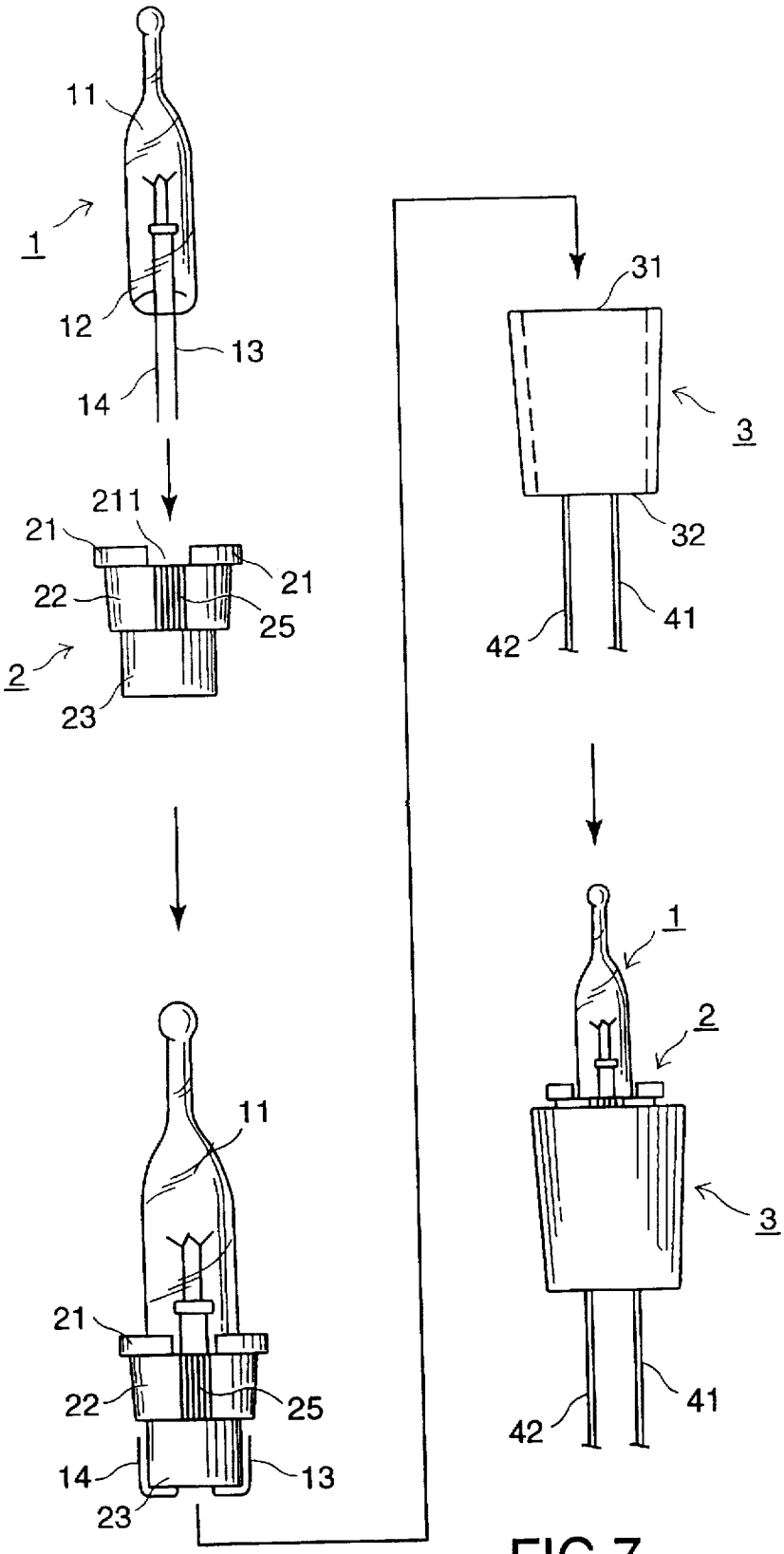
FIG. 7 is an exploded view of the forth embodiment of the lamp socket unit of the present invention showing the structure of the combination of the lamp bulb, lamp base and lamp holder.
Figure 8:
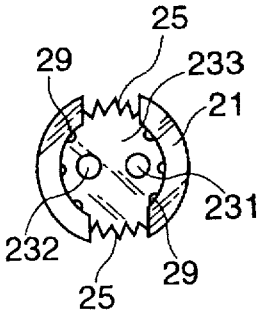
FIG. 8 depicts the top view of the lamp base shown in FIG. 7.

FIGS. 7 and 8 are the fourth embodiment of the lamp socket unit of the present invention showing the structure of the combination of the lamp bulb, the lamp base and the lamp holder. The combination method is completely resembling the FIG. 1. However, the shrinkable or expandable part 25 in the neck 22 of the lamp base 2 is in the form of bending and twist, which are resembling FIGS. 3 and 4. In the inner edge or outer edge of the other part of neck 22, one or more than one lug is provided whereby to reinforce the combination force of the lamp base 2 and the lamp holder 3.

Figure 9:
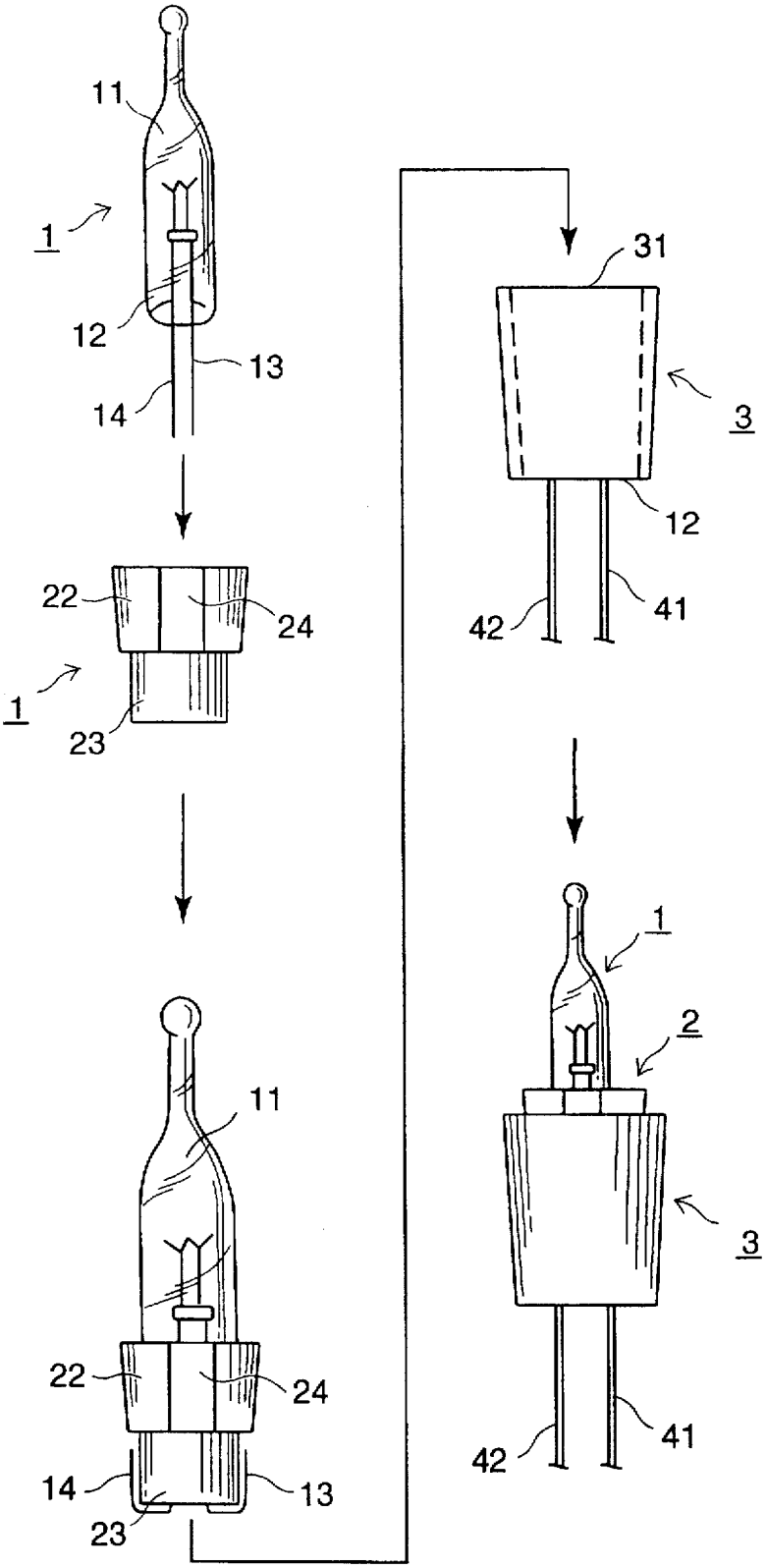
FIG. 9 is an exploded view of the fifth embodiment of the lamp socket unit of the present invention showing the structure of the combination of the lamp bulb, lamp base and lamp holder.
Figure 10:
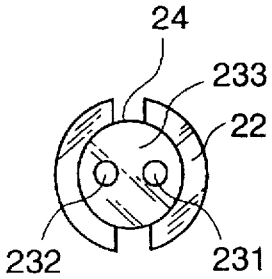
FIG. 10 depicts the top view of the lamp base shown in FIG. 9.

FIGS. 9 and 10 are the fifth embodiment of the lamp socket unit of the present invention showing the structure of the combination of the lamp bulb, the lamp base and the lamp holder. The combination method is completely resembling the FIG. 1. In FIGS. 9 and 10 which are different from FIGS. 1 and 2, the part of lamp base 2 is without having lug. When the lamp base 2 is inserted into the lamp holder 3, the upper part of the neck 22 is equal to the upper part of the lamp holder 3 or is higher the upper part of said lamp holder 3 (as shown in FIG. 9).

Figure 11:
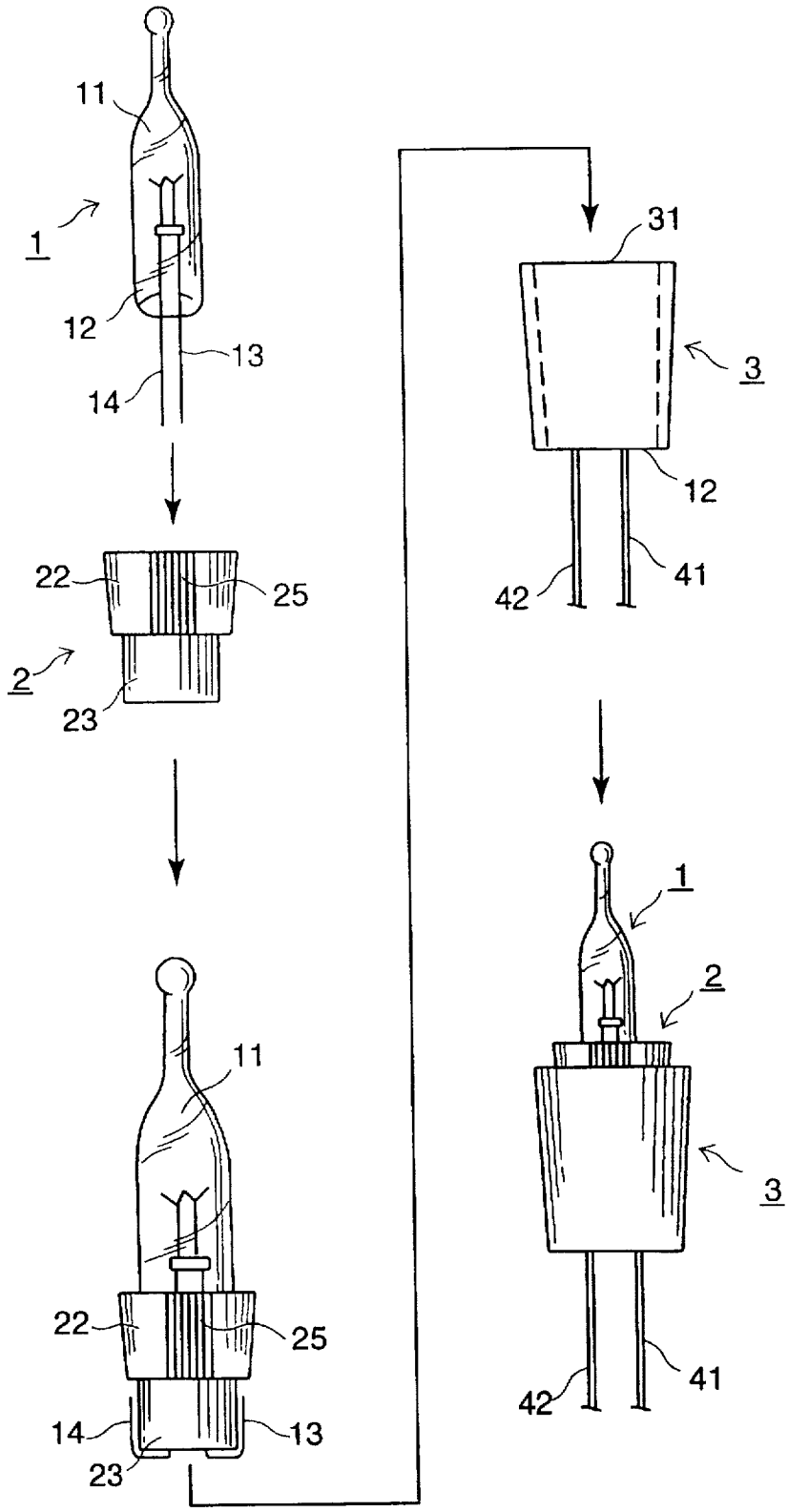
FIG. 11 is an exploded view of the sixth embodiment of the lamp socket unit of the present invention showing the structure of the combination of the lamp bulb, lamp base and lamp holder.
Figure 12:
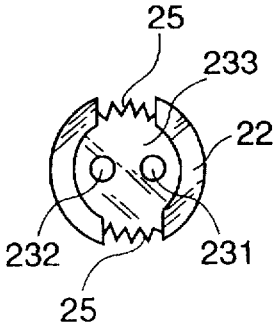
FIG. 12 depicts the top view of the lamp base shown in FIG. 11.

FIGS. 11 and 12 are the sixth embodiment of the lamp socket unit of the present invention showing the structure of the combination of the lamp bulb, the lamp base and the lamp holder. The combination method is completely resembling the FIG. 1. In FIGS. 10 and 11, which are different from FIGS. 3 and 4, the part of lamp base 2 is without having lug. When the lamp base 2 is inserted into the lamp holder 3, the upper part of the neck 22 is equal to the upper part of the lamp holder 3 or is higher the upper part of said lamp holder 3 (as shown in FIG. 11.)

Figure 13:
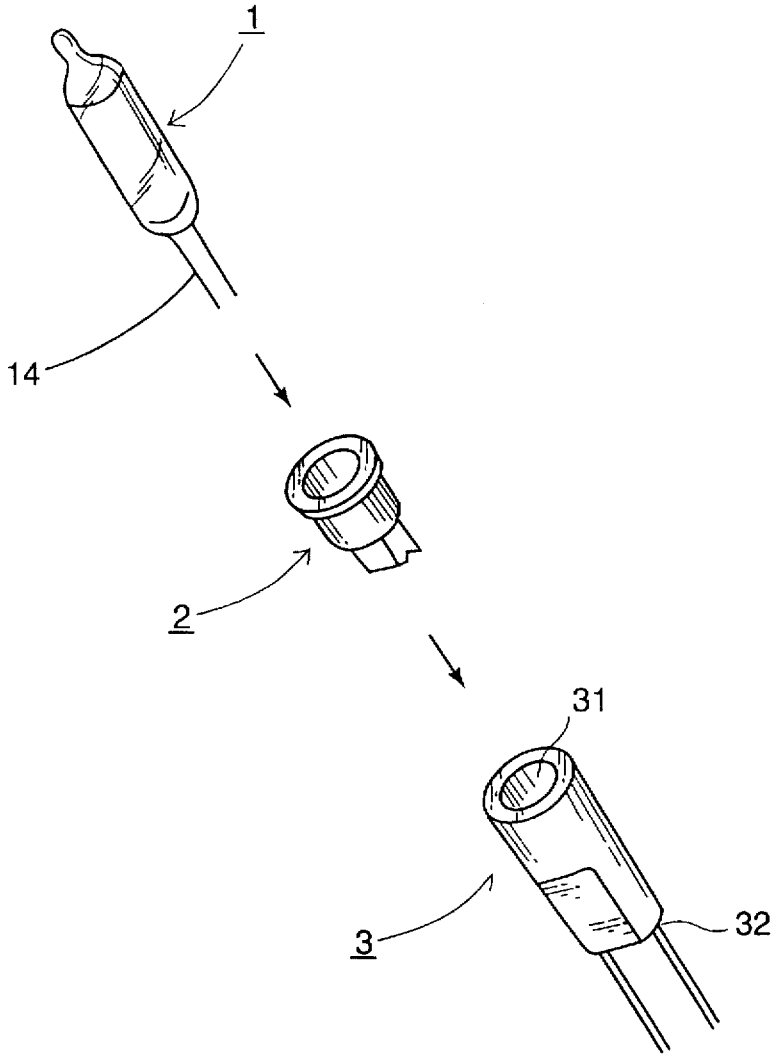
FIG. 13 is an exploded perspective view showing the main components in conventional lamp socket unit.

Now referring to FIG. 13, a conventional lamp socket unit comprises a lamp bulb 1 to be pushed in a lamp base 2 which is in turn pushed into a lamp holder 3 to complete the assemblage. A pair of conductor wires 14 leading from the rear end of said bulb 1 is to pass through the rear end opening of lamp base 2 to get into contact with a pair of predispose terminals connected to the power source of the decorative lighting string. The holding together of the components is effected through the self-containing frictional force between contacting surfaces which are not so reliable as to prevent slippage and loosening of the members of the unit so formed. Concerning the combination of the lamp bulb, the lamp base and the lamp holder, such is the conventional method.

The features and preferred embodiments of the present invention have been described in the foregoing specification. The invention intended to be protected herein , however, is not to be construed as limited to the particular forms disclosed. Variations and changes which may be made by those skilled in the art are with out departing from the scope of the present invention.

What I claimed is:

1. A lamp socket unit comprising:

a lamp holder defining a front end opening on one end of said lamp holder, said lamp holder including a pair of terminals positioned in said front end opening, said lamp holder including holder conductors electrically connected to said terminal and extending outward from said lamp holder;

a lamp base defining a bulb opening on one end of said lamp base, said lamp base having a base end defining a pair of conductor holes, said lamp base including a neck positioned between said base end and said bulb opening, a diameter of said neck being larger than a diameter of said front end opening;

elastic deformation means positioned in said neck of said lamp base and for elastically deforming to reduce said diameter of said neck when said lamp base is inserted into said front end opening of said lamp holder, said elastic deformation means biasing said neck in a direction to fix said lamp base in said lamp holders said deformation means being a strip that extends along an axial length of said neck and has a radial thickness, said radial thickness of said deformation means being thinner than a radial thickness of said neck;

a lamp bulb having a pair of bulb conductors extending from an end of said lamp bulb, said lamp bulb being insertable into said bulb opening of said lamp base, said bulb conductors being insertable into said conductor holes of said lamp base and bendable around said base end of said lamp base to contact said terminals of said lamp holder when said lamp bulb is inserted into said lamp base and said lamp base is inserted into said lamp holder.

2. The unit according to claim 1, wherein said deformation means of the base becomes turned and twisted when the lamp base together the lamp bulb are positioned in the front end opening of the lamp holder, the turned and twisted deformation means being compressed and transfigured to enable the lamp base together with the lamp bulb to be firmed fixed in the lamp holder.

3. The unit according to claim 2, wherein a direction of streaks on the turned and twisted deformation means being the same as those of the lamp base and lamp bulb inserted into the lamp holder.

4. The unit according to claim 1, wherein one of an outside and inside of the neck of said base being one of shrinkable and expandable so as to emphasize a combined force of the lamp bulb, lamp base and lamp holder.

5. A lamp socket unit in accordance with claim 1, wherein:

said deformation means is formed in one piece with said lamp base.

6. A lamp socket unit in accordance with claim 1, wherein:

said deformation means is formed from a same material as said lamp base.

7. A lamp socket unit in accordance with claim 1, wherein:

said deformation means is positioned in a circumferential interruption in a wall of said neck, said deformation means elasticity biasing sides of said circumferential interruption in a circumferential direction of said neck.

8. A lamp socket unit in accordance with claim 1, wherein:

said lamp bulb includes a vacuum part with a filament inside.

9. A lamp socket unit in accordance with claim 1, wherein:

said lamp base includes a lug positioned around said bulb opening and having a diameter greater than said diameter of said neck.

10. A lamp socket unit in accordance with claim 9, wherein:

said lug defines a breach in an area of said deformation means.

11. A lamp socket unit comprising:

a lamp holder defining a front end opening on one end of said lamp holder, said lamp holder including a pair of terminals positioned in said front end opening, said lamp holder including holder conductors electrically connected to said terminal and extending outward from said lamp holder;

a lamp base defining a bulb opening on one end of said lamp base, said lamp base having a base end defining a pair of conductor holes, said lamp base including a neck positioned between said base end and said bulb opening, a diameter of said neck being larger than a diameter of said front end opening;

elastic deformation means positioned in said neck of said lamp base and for elastically deforming to reduce said diameter of said neck when said lamp base is inserted into said front end opening of said lamp holder, said elastic deformation means biasing said neck in a direction to fix said lamp base in said lamp holder, said deformation means extending along an axial length of said neck and positioned in a circumferential interruption in a wall of said neck, said deformation means elasticity biasing sides of said circumferential interruption in a circumferential direction of said neck;

a lamp bulb having a pair of bulb conductors extending from an end of said lamp bulb, said lamp bulb being insertable into said bulb opening of said lamp base, said bulb conductors being insertable into said conductor holes of said lamp base and bendable around said base end of said lamp base to contact said terminals of said lamp holder when said lamp bulb is inserted into said lamp base and said lamp base is inserted into said lamp holder.

* * * * *